US005207066A

United States Patent [19]

Bova et al.

[11] Patent Number: 5,207,066

[45] Date of Patent: May 4, 1993

[54] METHOD OF AIR SEPARATION

[76] Inventors: Vitaly I. Bova, ulitsa Frunze, 26, kv. 52; Ilya V. Gorenshtein, ulitsa Lenina, 48, kv. 14; Boris E. Kitsis, ulitsa Budennogo, 1, kv. 21; Anatoly E. Poberez-Kin, ulitsa Yaroslavskogo, 45, kv. 73, all of Odessa; Evgeny V. Novikov, ulitsa Mogilevskaya, 6, kv. 78, Minsk, all of U.S.S.R.

[21] Appl. No.: 701,806

[22] Filed: May 17, 1991

[51] Int. Cl.[5] ..... F25J 3/04

[52] U.S. Cl. ..... 62/22; 62/24

[58] Field of Search ..... 62/22, 24

[56] References Cited

U.S. PATENT DOCUMENTS

| | | | |
|---|---|---|---|
| 4,575,388 | 3/1986 | Okada | 62/22 |
| 4,705,548 | 11/1987 | Agrawal et al. | 62/22 |
| 4,715,873 | 12/1987 | Auvil et al. | 62/22 |
| 5,019,145 | 5/1991 | Rohde et al. | 62/22 |
| 5,034,043 | 7/1991 | Rottmann | 62/22 |

FOREIGN PATENT DOCUMENTS

3840506A1 6/1990 Fed. Rep. of Germany .

*Primary Examiner*—Ronald C. Capossela

*Attorney, Agent, or Firm*—Beveridge, DeGrandi, Weilacher & Young

[57] ABSTRACT

A method includes separating at least 70% by volume of air in a double rectifier into oxygen, nitrogen gas and a gaseous argon fraction containing not more than 0.5% by volume of nitrogen. The latter is liquefied and fed into a rectifying column at a pressure exceeding a condensing pressure of the argon-nitrogen fraction by a value of from 0.01 to 0.06 MPa. A part of nitrogen gas is divided into two flows, a first of which is fed into the double rectifier and a second in an amount of not more than 40% by volume is sent into an evaporator of the rectifying column to deliver heat. The second flow of nitrogen may be changed by a part of the air being processed to be sent to said evaporator in an amount not in excess of 30% by volume.

10 Claims, 5 Drawing Sheets

METHOD OF AIR SEPARATION

FIELD OF THE INVENTION

The present invention is in the field of a low-temperature separation of gas mixtures, and more specifically is concerned with a method of air separation with recovering oxygen, nitrogen and argon.

BACKGROUND OF THE INVENTION

At the present time there are known in the art various methods of complex separation of air with obtaining oxygen, nitrogen, argon, krypton, xenon and neon.

These methods are based on low-temperature processes of rectification, distillation, dephlagmation and adsorption, as well as on high-temperature processes of catalytic hydrogenation, adsorption. Most wedely used for air separation is a method of a low-temperature rectification which provides obtaining both the main products, viz. oxygen, nitrogen, and fractions for the following recovery of argon, krypton, xenon and neon.

Known in the art is a method of air separation with the aim of recovering argon (U.S. Pat. No. 4,575,388) by way of a low-temperature rectification, comprising:

separating air in a double rectifier incorporating a high-pressure column, a condenser and a low-pressure column with taking-out oxygen, nitrogen and a gaseous argon fraction with a large content of oxygen from the latter;

enriching said argon fraction in a rectifying column with obtaining crude argon containing not less than 2% by volume of oxygen and nitrogen.

The obtained crude argon is heated, compressed and divided into two flows one of which is directed for further purification, whereas a second one is used for establishing an argon circulation cycle.

With this in view, gaseous crude argon is heated, compressed up to a pressure sufficient for evaporating liquid oxygen in said condenser, cooled in a heat exchanger and liquefied by heat exchange with the liquid oxygen from the condenser. The liquefied argon is introduced as a reflux into the rectifying column.

Using the argon circulation cycle makes it possible to enhance an argon recovery factor from 0.66 to 0.75. However, its formation requires using special devices for supplying liquid crude argon into the rectifying column mounted at a considerable height. This affects the operational reliability of the plant and makes its automatic control circuit more complicated.

This method does not provide complete separation of oxygen from argon, which calls for special methods of purification since due to a small difference between boiling points of oxygen and argon the conventional method of low-temperature rectification is impracticable.

Known in the art is a method of air separation by a low-temperature rectification, which provides recovery of argon, oxygen and nitrogen (DE, B, 3,840,506).

The method includes compression, purification, cooling and separation of not less than 70% by volume of air in a high-pressure column of a double rectifier into liquid air enriched with oxygen, and liquid nitrogen. The liquid air and nitrogen obtained are directed into a low-pressure column to be separated into oxygen, nitrogen gas and a gaseous argon fraction.

The argon fraction is fed into a rectifying column to be separated into an argon-nitrogen fraction and a liquid fraction of high-boiling components containing 90% by volume of oxygen, 0.15% by volume of nitrogen and argon being the balance. The fraction of high-boiling components is returned to the low-pressure column.

The method contemplates delivery of a part of gaseous air into the low-pressure column which is one of the reasons for lowering at factor of argon recovery (argon yield) from the air to a value of 0.5.

A pressure in the rectifying column is maintained equal to a pressure in the low-pressure column which limits a condensating temperature of vapours in its condenser and accordingly limits a nitrogen content therein to 0.05% by volume. At the same time the sensitivity to changes in parameters of the process increases, its stability decreases, which also results in lowering the argon recovery factor.

To reduce concentration of oxygen in the argon-nitrogen fraction obtained in the rectifying column, the column has a considerable height. Therefore removal of the liquid fraction of high-boiling components therefrom with the following supply into the low-pressure column requires using special devices, e.g. pumps. Presence of such devices reduces the operational reliability of the plant and complicates the automatic control circuit thereof.

SUMMARY OF THE INVENTION

It is an object of the present invention to enhance an argon recovery factor. Another object of the invention is to increase the reliability of carrying out the process.

These objects are achieved by that in a method of air separation by way of a low-temperature rectification, comprising compression, purification, cooling and separation of not less than 70% by volume of air in a high-pressure column of a double rectifier into liquid air enriched with oxygen, and liquid nitrogen, at least one part of each of which is sent to a low-pressure column to be separated into oxygen, nitrogen gas and a gaseous argon fraction, the latter being fed into a rectifying column to be separated at least into one argon-nitrogen fraction and a liquid fraction of high-boiling components, in which according to the invention the gaseous argon fraction containing not more than 0.5% by volume of nitrogen is preliquefied and supplied into the rectifying column under a pressure exceeding a condensing pressure of an argon-nitrogen fraction being roformed by a value of from 0.01 to 0.06 MPa, and some part of the nitrogen gas is compressed, cooled and divided into two flows one of which is directed to the high-pressure column and the other nitrogen flow in an amount of not more than 40% of the volume of the air being processed is fed into an evaporator of the rectifying column to deliver heat with the following evaporation, heating and feeding thereof for compression.

The method of the invention provides for considerably enhancing the argon recovery factor equalling from 0.88 to 0.91. This depends on the following.

Feeding all the liquefied argon fraction into the rectifying column under a pressure sufficient for overcoming a hydraulic resistance in its upper part makes it possible to exlude return of a greater part of this fraction to the double rectifier as in Application DE, B, 3,840, 506, and accordingly to decrease removal of the gaseous argon fraction therefrom. Owing to this a nitrogen content in this fraction increases up to 0.5% by volume, which provides an increase of the foregoing factor.

Moreover, using a nitrogen circulation cycle in the double rectifier and the rectifying column improves the separation conditions, reduces losses of argon with products removed from the double rectifier. This also makes it possible to enhance the argon recovery factor and to increase the reliability of the separation process at the expense of widening a control range of the process parameters and consequently to simplify the automation of the process. A value of 0.01 MPa of the lower limit of the difference between pressures at the inlet of the liquid argon fraction is restricted by the hydraulic parameters of the known types of the rectifying columns. With the upper limit of 0.06 MPa exceeded conditions of rectification of the argon fraction are deteriorated because of a pressure rise in the upper part of the rectifying column. The given range of difference of pressures from 0.01 to 0.06 MPa provides realization of the separation process in the rectifying column having from 140 to 270 trays. With supply into the evaporator of the rectifying column for delivery of heat of the compressed and cooled nitrogen not exceeding 40% of the volume of the air being processed there increases the total amount of circulation nitrogen and respectively consumption of power for its compression without enhancing the argon recovery factor.

When practising the method of the invention in the low-pressure plants, preferably not more than 30% of the volume of the compressed, purified and cooled air being processed is supplied to the low-pressure column for separation.

To optimize the separation process in the rectifying column prior to liquefying the argon fraction may be fed into an additional rectifying column to be enriched with low-boiling components. In this case the argon yield will be maximum at the expense of reduction of the number of trays in the rectifying column and its hydraulic resistance.

Before supplying into the additional rectifying column the gaseous argon fraction may be mixed with the fraction of high-boiling components from the rectifying column subjected to evaporation, which makes it possible to utilize the argon and to enhance the yield thereof.

The liquid nitrogen from the evaporator of the rectifying column may be throttled and fed for evaporation to its condenser as a coolant. This reduces the condensing temperature of argon-nitrogen mixture and lowers down the pressure in the place of the argon fraction inlet into the rectifying column and consequently improves conditions of the argon fraction rectification, which results in enhancing the argon recovery factor.

Preferably, the gaseous argon fraction is liquefied by a part of liquid air enriched with oxygen or by a part of liquid nitrogen, which are taken from the high-pressure column and subjected to throttling. Using liquid air or liquid nitrogen as a coolant makes it possible to reduce power consumption at the expense of using external coolants.

It is recommended to supply nitrogen gas into the evaporator of the rectifying column in an amount of from 25 to 35% of the volume of the air being processed and the gaseous argon fraction containing from 0.01 to 0.04% by volume to preliquefy and separate in the rectifying column into two argon-nitrogen fractions, one of which contains not more than 93% by volume of argon and a second contains not less than 99.993% by volume of argon, and a liquid fraction of high-boiling components including not more than 99.9% by volume of oxygen.

Delivery of such amount of nitrogen to the evaporator makes it possible to increase supply of compressed circulation nitrogen to the condenser of the double rectifier, which improves the conditions of separation and makes it possible to obtain an argon fraction having a low content of nitrogen and good for processing. Such a fraction provides for obtaining in the process of rectification of an argon-nitrogen fraction containing not less than 99.993% by volume of argon, which does not require a further cleaning from nitrogen.

These objects are achieved by that in a method of air separation by way of a low-temperature rectification, including compression, purification, cooling and separation of not less than 70% by volume of air in a high-pressure column of a double rectifier into liquid air enriched with oxygen, and liquid nitrogen, which are sent into a low-pressure column to be separated into oxygen, nitrogen gas and a gaseous argon fraction, the latter being directed to a rectifying column for separating at least into one argon-nitrogen fraction and a liquid fraction of high-boiling components, in which according to the invention the gaseous argon fraction containing not more than 0.5% by volume of nitrogen is preliquefied and supplied into the rectifying column under a pressure exceeding a condensing pressure of an argon-nitrogen fraction being formed by a value of from 0.01 to 0.06 MPa, and a part of compressed, purified and cooled air being processed in an amount of not more than 30% by volume is fed into an evaporator of the rectifying column to deliver heat, the obtained liquefied air is throttled and supplied as a coolant into a condenser of the rectifying column, whereupon the gaseous air is sent into the low-pressure solumn for separation, and a part of the nitrogen gas from the low-pressure column in an amount not exceeding 30% of the volume of the air being processed is heated, compressed, cooled and fed into the double rectifier.

Forming an air circuit for the rectifying column makes it possible to reduce the amount of nitrogen to be compressed in a nitrogen circulation compressor and consequently to reduce substantially the power consumption.

The argon-nitrogen fraction may be fed to a pure argon rectifying column to be separated into pure argon and a nitrogen fraction, which improves quality of obtained products without additional processing.

BRIEF DESCRIPTION OF THE DRAWINGS

The invention will now be described by way of example with reference to the accompanying drawings in which.

DETAILED DESCRIPTION OF THE INVENTION

Figure 1:
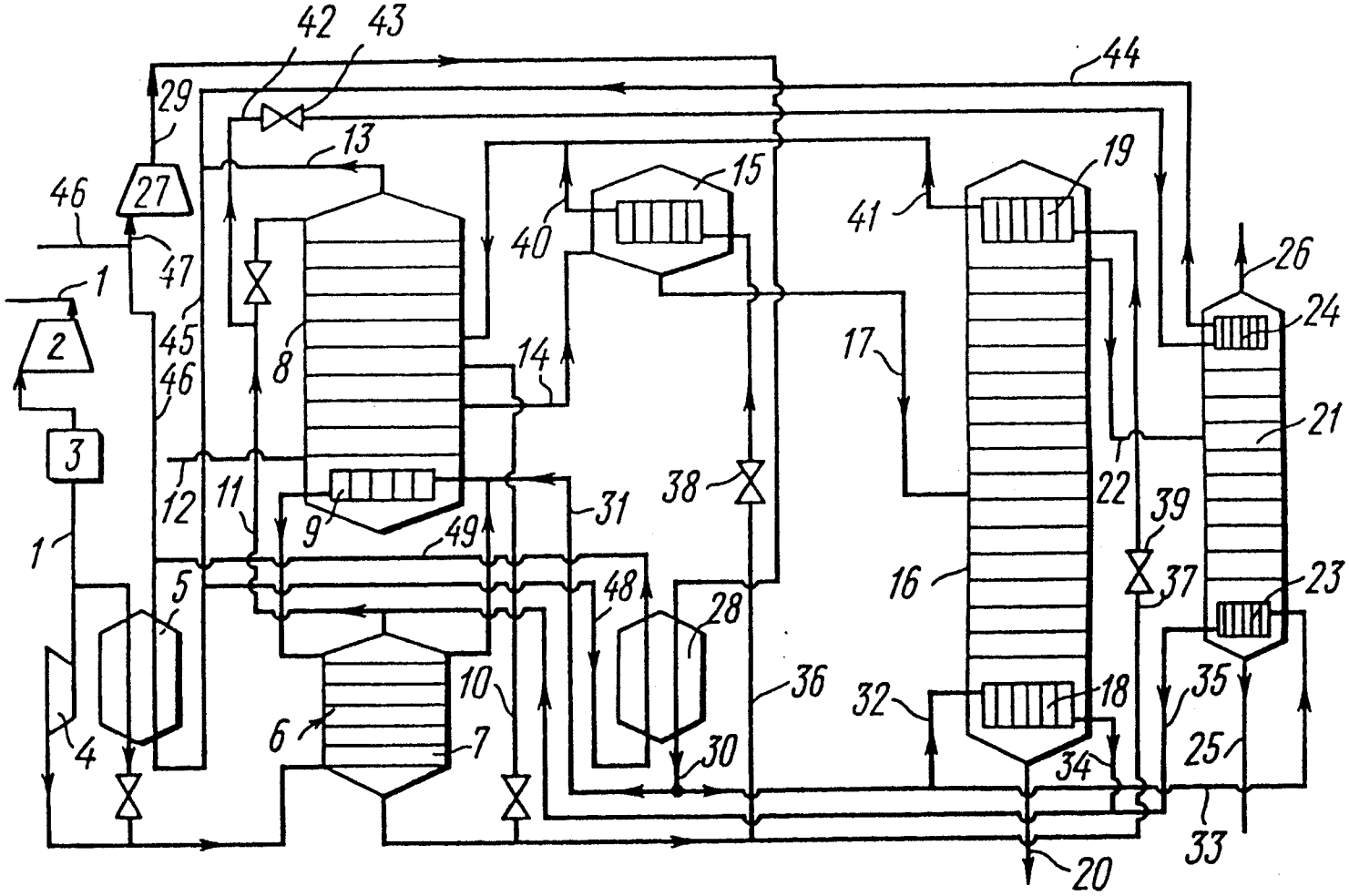
FIG. 1 schematically illustrates a plant using a nitrogen circulation cycle.

A plant for practising the method according to the invention, shown in FIG. 1, incorporates the following elements mounted in a line 1 according to the flow sheet: an air compressor 2, a device 3 for purifying air from moisture, carbon dioxide and hydrocarbons, an expander 4, a main heat exchanger 5 and a double rectifier 6 comprising a high-pressure column 7, a low-pressure column 8 and a main condenser 9. The columns 7 and 8 are communicated through a line 10 supplying liquid air enriched with oxygen and through a line 11 to supply liquid nitrogen. Connected to the column 8 are an oxygen outlet line 12, a nitrogen gas outlet line 13 and a gaseous argon fraction outlet line 14. The line 14 is connected with an additional condenser 15 which communicates with a rectifying column 16 through a liquid argon fraction supply line 17. The condenser 15 is installed at a height sufficient to provide a pressure in the place of the argon fraction inlet, which exceeds an argon-nitrogen fraction condensing pressure by a value of from 0.01 to 0.06 MPa, which makes it possible to overcome a hydraulic resistance of the upper part of the column 16. The column 16 is provided with an evaporator 18 and a condenser 19 and has a line 20 to withdraw a liquid fraction of high-boiling components. The column 16 communicates with a pure argon column 21 through a line 22 to supply the liquid argon-nitrogen fraction. The column 21 has an evaporator 23, a condenser 24, a pure argon outlet line 25 and a nitrogen fraction outlet line 26.

The plant is provided with a circulation nitrogen cycle including a nitrogen circulation compressor 27, a circulating heat exchanger 28, connected by a compressed nitrogen gas line 29. At the outlet from the heat exchanger 28 there is a line 30 divided into a line 31 feeding nitrogen gas to the condenser 9, a line 32 to the evaporator 18 and a line 33 to the evaporator 23. The line 11 is connected with a line 34 to remove liquid nitrogen from the evaporator 18, connected to which is a line 35 to remove liquid nitrogen from the evaporator 23. To the line 10 of liquid air enriched with oxygen the condenser 15 is connected by a line 36 and a condenser 19 is connected by a line 37. The lines 36, 37 are provided with throttle valves 38, 39 respectively. The condensers 15 and 19 are connected to the column 8 respectively by lines 40, 41 to remove gaseous air enriched with oxygen. The condenser 24 is communicated with the line 11 by means of a liquid nitrogen feed line 42 provided with a throttle valve 43. A line 44 removing the nitrogen gas from the condenser 24 communicates with the line 13 connected to which through a nitrogen gas supply line 45 is the main heat exchanger 5. The heat exchanger 5 is provided with a line 46 to remove the nitrogen gas from the plant, to which line there is connected the compressor 27 with the aid of a line 47. The heat exchanger 28 through a nitrogen gas inlet line 48 is connected to the line 45, and through a nitrogen gas outlet line 49, to the line 46.

The method according to the invention is realized in the following way. All air to be processed on being compressed in the compressor 2 and purified from moisture, carbon dioxide and hydrocarbons in the device 3 is fed through the line 1 to the expander 4 and the main heat exchanger 5. A part of air amounting to 60% of the volume of the air being processed is expanded in the expander 4 and the remaining air is cooled in the heat exchanger 5, throttled and on being mixed with the air from the expander 4 is fed into the column 7 for separation. From the upper part of the column 7 there is taken liquid nitrogen containing 0.0001% by volume of oxygen, which is divided into two parts: 28% of the volume of the air being processed is introduced through the line 11 into the column 8 as a reflux, whereas 2% of the volume of the air being processed is sent through the line 42 and the valve 43 into the condenser 24 and after evaporation is supplied through the line 44 to the line 45. From the lower part of the column 7 there is removed liquid air enriched with oxygen up to 29-30% by volume and divided into three flows: one flow amounting to 14% of the volume of the air being processed is throttled and fed through the line 10 to the column 8, a second flow amounting to 28% of the volume of the air being processed through the line 36 and the valve 38 is supplied as a coolant into the condenser 15 and further after evaporation through the line 40 to the column 8, and a third flow in the amount of 28% of the volume of the air being processed is fed through the line 37 and the valve 39 into the condenser 19 and then after evaporation through the line 41 to the column 8. From the column 8 through the line 12 there is taken production oxygen in the amount of 11% of the volume of the air being processed and through the line 13 there is removed nitrogen gas which is passed through the line 45 to the heat exchanger 5 for heating. The nitrogen gas removed from the heat exchanger 5 is divided into two flows one of which amounting to not more than 80% of the volume of air being processed is discharged from the plant through the line 46, whereas another in an amount not exceeding 60% is sent through the line 47 to the nitrogen circulation compressor 27 to be compressed to a pressure from 0.75 to 0.8 MPa. The compressed nitrogen is fed through the line 29 to the heat exchanger 28.

Fed to the heat exchanger 28 through the line line 48 for cooling the compressed nitrogen is a low-pressure nitrogen gas which on being heated is passed through the line 49 to the line 46. The compressed cooled nitrogen gas through the line 30 is removed from the heat exchanger 28 through the line 30 and divided into three flows a first of which through the line 31 is fed to the condenser 9 to be liquefied. A second flow in an amount not exceeding 40% of the volume of the air being processed is directed through the line 32 to the evaporator 18 to deliver heat, from which the liquid nitrogen is removed through the line 34. A third flow through the line 33 is supplied into the evaporator 23 to deliver heat, liquefied and removed through the line 35. The liquid nitrogen flows through the lines 34 and 35 go to the line 11. From the middle part of the column 8 through the line 14 there is extracted a gaseous argon fraction in an amount of from 8 to 10% of the volume of the air being processed, comprising from 10 to 12% by volume of argon, 0.5% by volume of nitrogen and sent to the condenser 15 to be liquefied and then through the line 17 for separation into the column 16 from the upper part of which an argon-nitrogen fraction containing 0.0005% by volume of oxygen is fed through the line 22 for final separation into the column 21. From the lower part of the column 16 through the line 20 there is removed a liquid fraction of high-boiling components, e.g. production oxygen in an amount of 10% of the volume of the air being processed. From the column column 21 through the line 25 there is removed pure argon containing not more than 0.005% by volume of nitrogen and through the line 26, a nitrogen fraction containing not more than 8% by volume of argon.

The rectifying column 16 mounts 240 trays, the argon-nitrogen fraction pressure at the outlet from the column is maintained equal to 0.11 MPa, the temperature head between the argon-nitrogen fraction and the boiling liquid air enriched with oxygen equals from 2 to 2.4 degrees. The pressure at the inlet of the liquid argon fraction to the column 16 amounts to 0.15 MPa. The argon recovery factor according to the method described is equal to 0.90.

Figure 2:
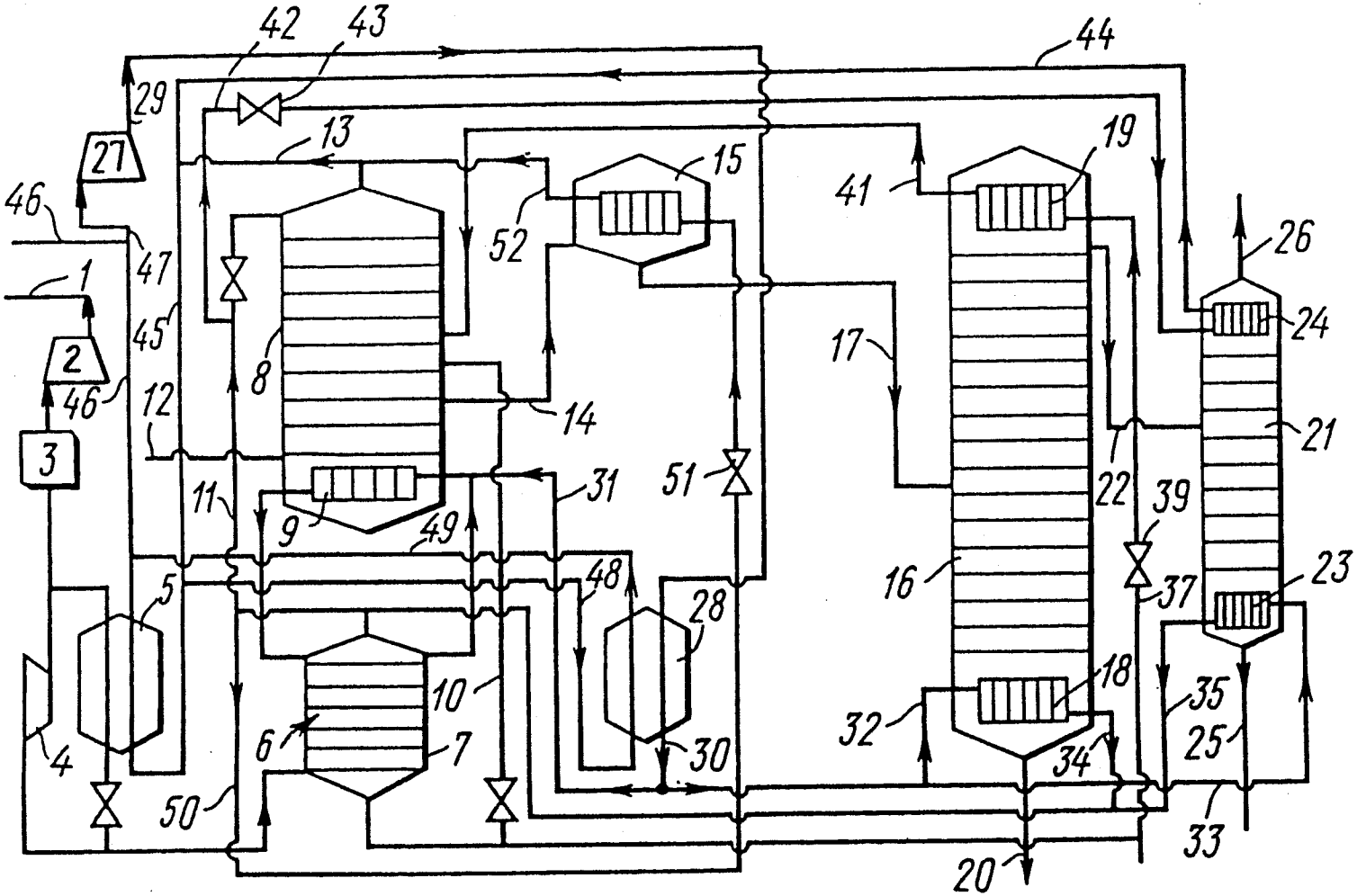
FIG. 2 shows the same plant as in FIG. 1, using liquid nitrogen in the condenser as a coolant.

Shown in FIG. 2 is a plant for practising the method according to the invention differing from the foregoing version in that the gaseous argon fraction is liquefied by throttled liquid nitrogen.

In FIG. 2 the condenser 15 communicates with the line 11 by means of a liquid nitrogen inlet line 50 provided with a throttle valve 51. The condenser 15 is connected with the line 13 with the aid of a nitrogen gas outlet line 52. The liquid nitrogen is taken from the line 11 through the line 50, throttled through the valve 51 and is further sent to the condenser 15 for liquefying the gaseous argon fraction. Removal of the nitrogen gas from the condenser 15 is carried out through the line 52.

Figure 3:
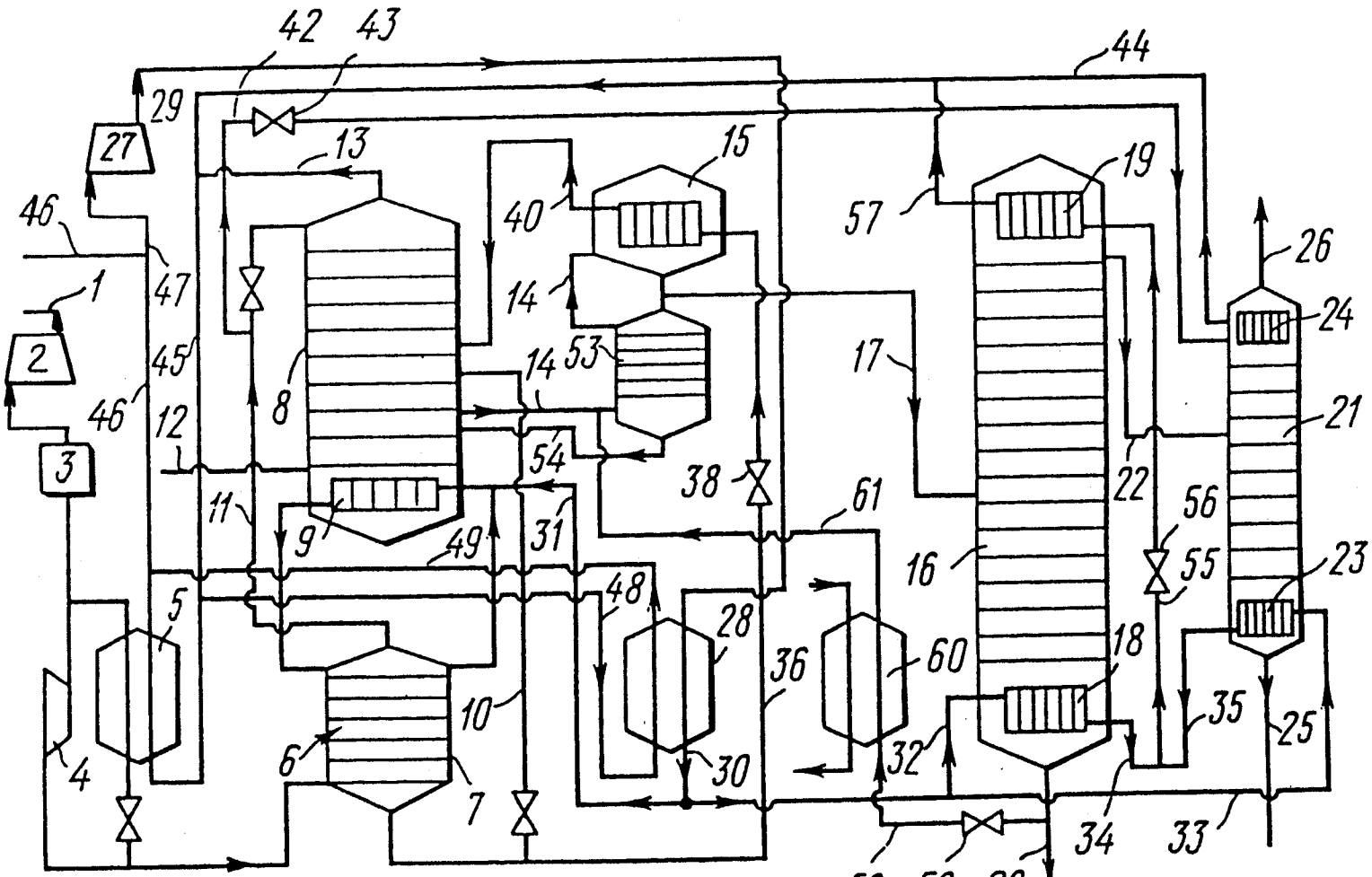
FIG. 3 shows the same plant as in FIG. 1 using an additional rectifying column.

Shown in FIG. 3 is a plant for practising a version of the method according to the invention, in which before being liquefied the argon fraction is enriched with low-boiling components, mixed with an evaporated fraction of high-boiling components, and the liquid nitrogen from the evaporators 18 and 23 is used as a coolant in the condenser 19. Connected to the line 14 in the region between the column 8 and the condenser 19 is an additional rectifying column 53. The lower part of the column 53 communicates with the column 8 through a liquid argon fraction outlet line 54. The lines 34, 35 are connected through a line 55 having a throttle valve 56 to the condenser 19 which communicates through a nitrogen gas outlet line 57 to the line 44. To the line 20 by means of a line 58 for feeding a liquid fraction of high-boiling components, provided with a valve 59, there is connected an evaporator 60 communicating with the aid of a line 61 for removing a gaseous fraction of high-boiling components to the line 14. The gaseous argon fraction through the line 14 is fed to the lower part of the additional rectifying column 53 to be enriched with low-boiling components, viz. nitrogen and argon, the oxygen content being not in excess of 3% by volume. The enriched fraction is liquefied in the condenser 15 and divided into two parts one of which in an amount not exceeding 1% of the volume of the air being processed through the line 17 is fed to the column 18 and a second is returned to the column 53 and further through the line 54 to the column 8. Flows of liquid nitrogen from the evaporators 18 and 23 through the lines 34, 35 respectively are fed to the line 55, throttled by the valve 56 and as a coolant are supplied to the condenser 19. The nitrogen gas evaporated in the condenser 19 is fed through the line 57 to the line 45. To recover argon, the fraction of high-boiling components through the line 58 is fed to the evaporator 60 and further through the line 61 joins the flow of the gaseous argon fraction through the line 14. In the case of removal of the high-boiling components from the plant the valve 59 is closed.

When the method is practised in the plant of FIG. 3 the rectifying column 16 mounts 140 trays, the argon-nitrogen fraction pressure at the outlet from the column is 0.11 MPa, the temperature head between the argon-nitrogen fraction and the boiling liquid nitrogen amounts from 1.9 to 2.2 degrees. The pressure in the place of liquid argon fraction inlet to the column 16 is equal to 0.12 MPa. The argon recovery factor in accordance with the foregoing method equals 0.91.

Figure 4:
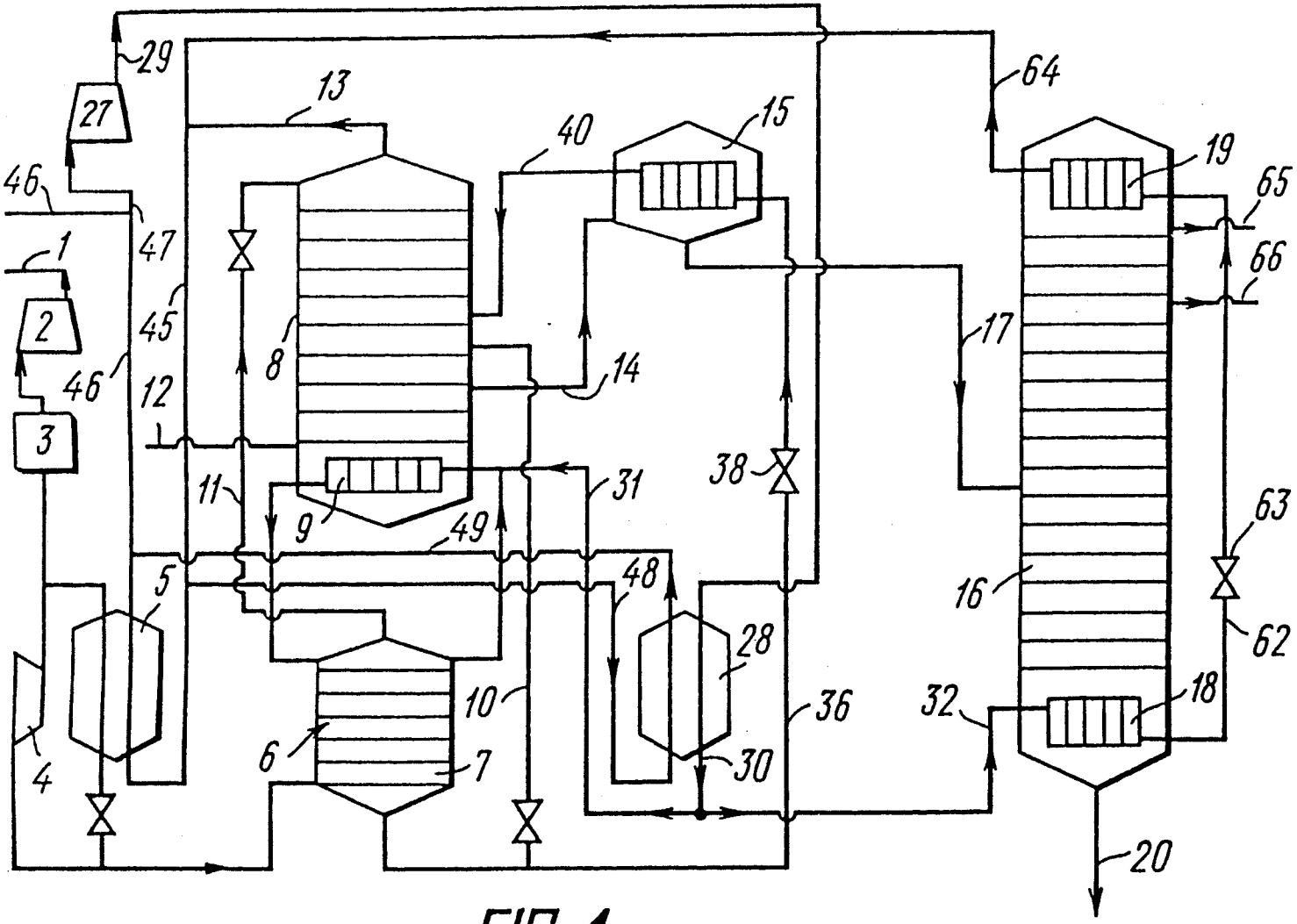
FIG. 4 shows the same plant as in FIG. 1, having a rectifying column with two lines to take-out argon-nitrogen fractions of different composition.

Shown in FIG. 4 is a plant for realizing a version of the method of the invention, in which the liquefied argon fraction is separated in the rectifying column 16 into a liquid fraction of high-boiling components containing 99.9% by volume of oxygen and two argon-nitrogen fractions. The evaporator 18 of the column 16 communicates with the condenser 19 by a liquid nitrogen feed line 62 having a throttle valve 63. The condenser 19 is connected by a nitrogen gas outlet line 64 with the line 45. The column 16 has outlet lines 65, 66 for gaseous argon-nitrogen fractions. The compressed cooled nitrogen is passed from the heat exchanger 28 through the line 30 and divided into two flows, a first of which in an amount of 35% of the volume of the air being processed is fed through the line 31 to the condenser 9 for liquefaction. A second flow amounting to 25% of the volume of the air being processed through the line 32 is fed to the evaporator 18 to deliver heat. From the evaporator 18 the liquid nitrogen is removed through the line 62 and the throttle valve 63 and fed as a coolant into the condenser 19 to be evaporated and through the line 64 to be sent to the nitrogen gas line 45. An increase in the amount of compressed cooled nitrogen supplied through the line 31 into the condenser 9 up to 35% of the volume of the air being processed makes it possible to provide in the gaseous argon fraction removed through the line 14 the content of nitrogen to be equal to 0.04% by volume.

When practising the method on the plant of FIG. 4 with the rectifying column 16 having 270 trays the pressure of the argon-nitrogen fraction removed through the line 65 is maintained equal to 0.11 MPa and the pressure of the argon-nitrogen fraction passed through the line 66 amounts to 0.13 MPa. The pressure in the place of inlet of the liquid argon fraction to the column 16 is equal to 0.17 MPa.

The content of argon in the argon-nitrogen fraction in the line 65 equals not more than 93% by volume and its amount does not exceed 1% of the volume of the air being processed. The content of argon in the argon-nitrogen fraction in the line 66 is equal to not less than 99.993% by volume. The liquid fraction of high-boiling components removed through the line 20 contains not more than 99.9% by volume of oxygen. The argon recovery factor according the method described above is equal to 0.91.

Figure 5:
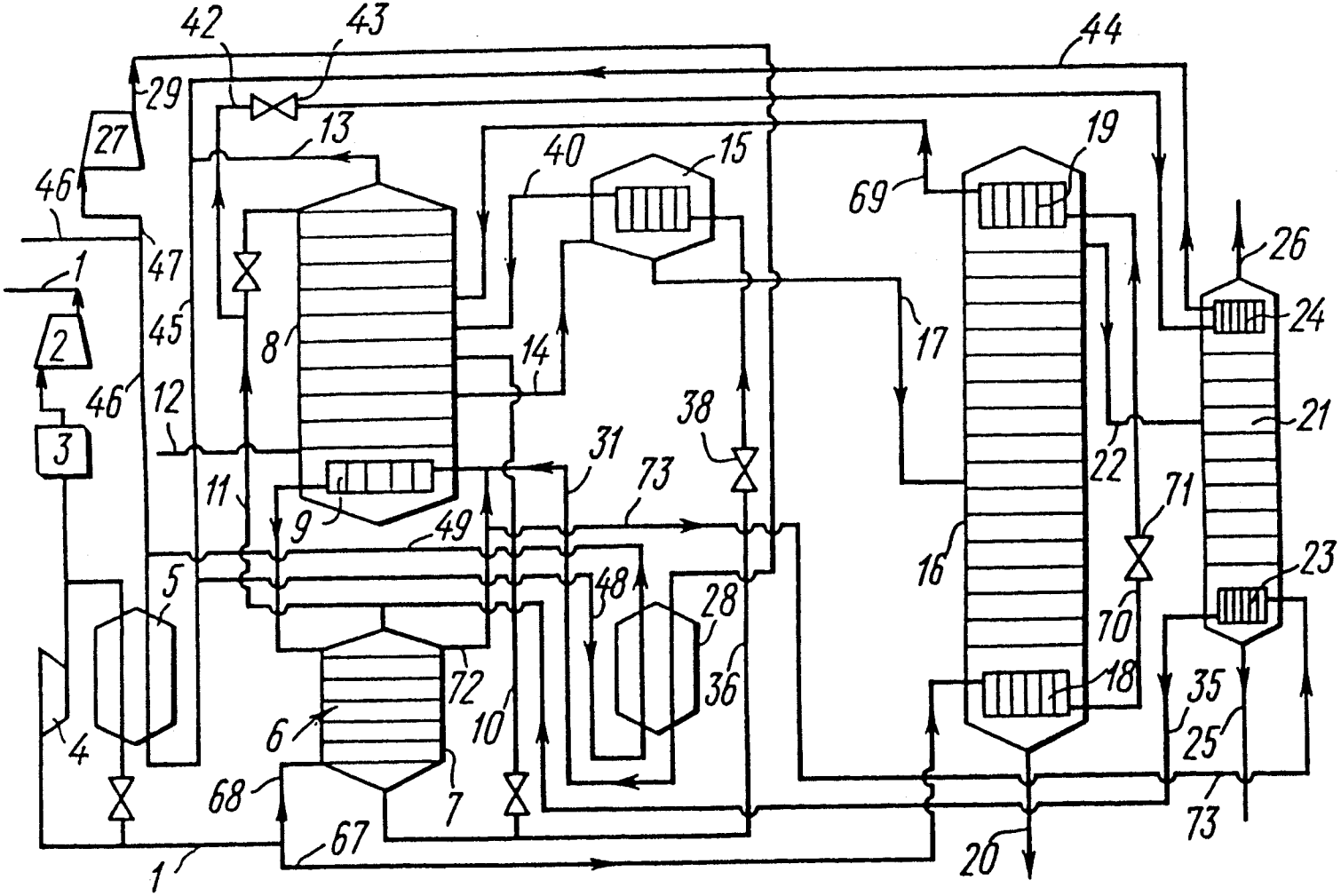
FIG. 5 schematically illustrates a plant having an air circuit for a rectifying column.

A plant for practising the method according to the invention shown in FIG. 5 includes the following elements mounted in a line 1 according to the flow sheet: an air compressor 2, a device 3 for purifying air form moisture, carbon dioxide and hydrocarbons, an expander 4, a main heat exchanger 5. The line 1 is divided into a line 67 feeding air into an evaporator 18 and a line 68 feeding air into a double rectifier 6 comprising a high-pressure column 7, a low-pressure column 8 and a main condenser 9. The columns 7 and 8 are communicated through a line 10 supplying liquid air enriched with oxygen and through a line 11 supplying liquid nitrogen. Connected to the column 8 are an oxygen outlet line 12, a nitrogen gas outlet line 13 and a gaseous argon fraction outlet line 14. The line 14 is connected to an additional condenser 15 communicating with a rectifying column 16 through a liquid argon fraction feed line 17. The condenser 15 is installed at a height sufficient to provide a pressure in the place of inlet of the argon fraction exceeding an argon-nitrogen fraction condensing pressure by a value of from 0.01 to 0.06 MPa, which makes it possible to overcome a hydraulic resistance of the upper part of the column 16. The column 16 is provided with an evaporator 18 and a condenser 19 and has an outlet line 20 for a liquid fraction of high-boiling components. The column 16 is connected with a pure argon column 21 by a line 22 to supply the argon-nitrogen fraction. The column 21 has an evaporator 23, a condenser 24, an outlet line 25 of pure argon and a nitrogen fraction outlet line 26.

The plant is provided with a nitrogen circulation cycle including a nitrogen circulation compressor 27, a criculating heat exchanger 28 connected by a compressed nitrogen gas line 29. Connected to an outlet of the heat exchanger 28 is a line 31 feeding nitrogen gas to the condenser 9. Connected to the line 11 is a line 35 to remove liquid nitrogen from the evaporator 23. To the line 10 supplying liquid air enriched with oxygen there is connected the condenser 15 with the aid of a line 36 having a throttle valve 38. The condenser 24 is connected to the line 11 with the aid of a liquid nitrogen feed line 42 and a throttle valve 43. A line 44 removing the nitrogen gas from the condenser 24 communicates with the line 13 connected to which through a nitrogen gas feed line 45 is the main heat exchanger 5. The heat exchanger 5 is provided with a line 46 to remove the nitrogen gas from the plant, to which line there is connected the nitrogen circulating compressor 27 with the aid of a line 47. The heat exchanger 28 through a nitrogen gas inlet line 48 is connected to the line 45 and through a nitrogen gas outlet line 49, to the line 46. The condenser 15 is connected to the column 8 by an outlet line 40 of air gas enriched with oxygen and the condenser 19, by an air gas outlet line 69. The evaporator 18 is connected with the condenser 19 by a line 70 having a throttle valve 71. In the double rectifier 6 the column 7 communicates with the condenser 9 through a nitrogen gas feed line 72. Connected to the line 72 is a line 73 feeding nitrogen gas to the evaporator 23.

The method according to the invention is realized in the following way. All air to be processed on being compressed in the compressor 2 and purified from moisture, carbon dioxide and hydrocarbons in the device 3 is fed through the line 1 to the expander 4 and the main heat exchanger 5. A greater part of air amounting to 60% of the volume of the air being processed is expanded in the expander 4 and the remainder of the air amounting to 40% of the volume of the air being processed is cooled in the main heat exchanger 5, throttled, joined with the flow downstream from the expander 4 and divided into two parts.

A first part in an amount of 70% of the volume of the air being processed is fed through the line 68 to the column 7. The remaining part of the air is supplied through the line 67 to the evaporator 18. From the upper part of the column 7 there is extracted liquid nitrogen containing 0.0001% by volume of oxygen, which is divided into two parts. A first one in an amount of 19% of the volume of the air being processed through the line 11 is introduced as a reflux into the column 8, whereas a second part in an amount of 2% of the volume of the air being processed is sent through the line 42 and the valve 43 to the condenser 24 and after evaporation is fed through the line 44 to the line 45. From the lower part of the column 7 there is taken liquid air enriched with oxygen up to 29–30% by volume and divided into two flows. A first flow in an amount of 21% of the volume of the air being processed is throttled in the line 10 and fed to the column 8, and a second flow in an amount of 28% of the volume of the air being processed is fed through the line 36 and the valve 38 to the condenser 15 and further after evaporation through the line 40 to the column 8. From the column 8 through the line 12 there is taken a production oxygen in an amount of 11% of the volume of the air being processed, and through the line 13 there is removed nitrogen gas which through the line 45 is fed to the heat exchanger 5 to be heated. From the heat exchanger 5 the nitrogen gas is removed and divided into two flows one of which is an amount not in excess of 80% of the volume of the air being processed is discharged from the plant through the line 46, another in an amount of 30% of the volume of the air being processed through the line 47 is fed to the nitrogen circulation compressor 27 to be compressed to a pressure of from 0.75 to 0.8 MPa. The compressed nitrogen through the line 29 is supplied to the heat exchanger 28. Also fed into the heat exchanger 28 to cool the compressed nitrogen through the line 48 is a low-pressure nitrogen gas which on being heated is fed to the line 46 through the line 49. The compressed cooled nitrogen gas is removed from the heat exchanger 28 through the line 31 to the line 72 and is fed to the condenser 9 for liquefaction. From the line 72 the nitrogen gas is removed and fed through the line 73 to the evaporator 23 to deliver heat, wherefrom on being liquefied it is passed through the line 35 to the line 11. From the middle part of the column 8 through the line 14 there is extracted a gaseous argon fraction containing from 10 to 12% by volume of argon, 0.3% by volume of nitrogen, in an amount of from 7 to 9% of the volume of the air being processed and is fed to the condenser 15 for liquefaction and further through the line 17 to the column 16 for separation. The air gas through the line 67 is fed to the evaporator 18 to deliver heat. After liquefaction the liquid air through the line 70 and the valve 71 is fed to the condenser 19 to be used as a coolant. The evaporated air gas through the line 69 is sent to the column 8 for separation. From the upper part of the column 16 an argon-nitrogen fraction containing 0.0005% by volume of oxygen is fed through the line 22 to the column 21 for final separation. From the lower part of the column 16 through the line 20 there is removed a liquie fraction of high-boiling components, viz. production oxygen in an amount of 10% of the volume of athe air being processed. From the lower part of the column 21 through the line 25 there is extracted production argon containing not more than 0.005% by volume of nitrogen, and from the upper part through the line 26 there is removed a nitrogen fraction containing not more than 8% by volume of argon. The rectifying column 16 mounts 250 trays, the argon-nitrogen fraction pressure at the outlet from the column equals 0.11 MPa, the temperature head between the argon-nitrogen fraction and the boiling liquid air ranges from 2 to 2.4 degrees. The pressure in the place of the inlet of the liquid argon fraction to the column 16 amounts to 0.155 MPa.

The argon recovery factor according to the described method is equal to 0.9.

The invention will find application in chemical industry and mechanical engineering.

What is claimed is:

1. A method of air separation by low-temperature rectification comprising the following steps:

compressing said air;

purifying said compressed air;

cooling said purified air;

separating not less than 70% by volume of said cooled air in a high-pressure column of a double rectifier into liquid air enriched with oxygen, and liquid nitrogen;

separating at least one part of said liquid air enriched with oxygen and at least one part of said liquid nitrogen in a low-pressure column of said double rectifier into oxygen, nitrogen gas and a gaseous argon fraction containing not more than 0.5% by volume of nitrogen;

liquefying said gaseous argon fraction;

separating said liquid argon fraction in a rectifying column into at least one argon-nitrogen fraction and a liquid fraction of high-boiling components under a pressure exceeding a condensing pressure of said argon-nitrogen fraction by a value of from 0.01 to 0.06 MPa;

compressing cooling and separating a part of said nitrogen gas taken from said low-pressure column into a first flow and a second flow;

sending the first of said nitrogen gas flows into said high-pressure column;

feeding the second of said nitrogen gas flows in an amount not more than 40% of the volume of the air being processed into an evaporator of said rectifying column to deliver heat and forming a liquid nitrogen flow;

evaporating said liquid nitrogen flow to form a nitrogen gas flow;

heating said nitrogen gas flow and compressing it.

2. A method as claimed in claim 1, in which prior to liquefying said gaseous argon fraction said gaseous argon fraction is fed into an additional rectifying column and is enriched with low-boiling components.

3. A method as claimed in claim 2, which includes the step of evaporating said liquid fraction of high-boiling components and forming a gaseous fraction of said high-boiling components;

mixing said gaseous fraction of high-boiling components with said gaseous argon fraction before feeding thereof into said additional rectifying column.

4. A method as claimed in claim 1, including throttling said liquid nitrogen flow before evaporating said liquid nitrogen flow to a gaseous nitrogen flow and feeding said liquid nitrogen flow into a condenser of said rectifying column as a coolant.

5. A method as claimed in claim 1, including the step of the throttling a part of said liquid air enriched with oxygen and/or a part of said liquid nitrogen prior to its being separated in said low pressure column.

6. A method as claimed in claim 5, in which said gaseous fraction containing nitrogen which is being subjected to liquefaction is present in an amount from 0.01 to 0.04% by volume; and said liquefied argon fraction is separated into a liquid fraction of high-boiling components containing not more than 99.9% by volume of oxygen and two argon-nitrogen fractions one of which contains not more than 93% by volume of argon and a second fraction contains not less than 99.993% by volume of argon.

7. A method as claimed in claim 1, wherein the amount of nitrogen gas in said second flow into said evaporator is from 25 to 35% of the volume of the air being processed.

8. A method as claimed in claim 1, including the step of throttling said part of said liquid air enriched with oxygen prior to separating said liquid air in said low pressure column into a condenser of said rectifying column as a coolant.

9. A method of air separation by low-temperature rectification comprising the following steps:

compressing said air;

purifying said compressed air;

cooling said purified air;

separating not less than 70% by volume of said cooled air in a high-pressure column of a double rectifier into liquid air enriched with oxygen, and liquid nitrogen;

separating said liquid air enriched with oxygen and said liquid nitrogen in a low-pressure column of said double rectifier into oxygen, nitrogen gas and gaseous argon fraction containing not more than 0.5% by volume of nitrogen;

liquefying said gaseous argon fraction;

separating said argon fraction after said liquefaction in a rectifying column into at least one argon-nitrogen fraction and a liquid fraction of high-boiling components under a pressure exceeding a condensing pressure of said argon-nitrogen fraction by a value of from 0.01 to 0.06 MPa;

heating, compressing and cooling a part of said nitrogen gas taken from said low-pressure column, the amount of said nitrogen gas being not more than 30% of the volume of the air being processed;

introducing said cooled part of said nitrogen gas into said double rectifier;

introducing said cooled air into an evaporator of said rectifying column to deliver heat and forming liquid air;

throttling said liquid air;

introducing said throttled air into a condenser of said rectifying column to deliver heat and forming gaseous air;

separating said gaseous air in said double rectifier.

10. A method as claimed in claim 9, including the steps of introducing said argon fraction obtained from said rectifying column into a pure argon rectifying column and then separating said argon-nitrogen fraction into argon and a nitrogen fraction.

* * * * *